US012789254B2

(12) United States Patent
Saeuberlich et al.

(10) Patent No.: US 12,789,254 B2
(45) Date of Patent: Nov. 10, 2026

(54) PROCESS FOR PRODUCING TUNGSTEN METAL POWDERS

(71) Applicant: H.C. Starck Tungsten GmbH, Munich (DE)

(72) Inventors: Tino Saeuberlich, Bad Harzburg (DE); Juliane Meese-Marktscheffel, Goslar (DE); Knut Warnecke, Goslar (DE); Beate Hoese, Goslar (DE)

(73) Assignee: H.C. Starck Tungsten GmbH, Munich (DE)

( * ) Notice: Subject to any disclaimer, the term of this patent is extended or adjusted under 35 U.S.C. 154(b) by 455 days.

(21) Appl. No.: 17/771,531

(22) PCT Filed: Dec. 14, 2020

(86) PCT No.: PCT/EP2020/085987
§ 371 (c)(1),
(2) Date: Apr. 25, 2022

(87) PCT Pub. No.: WO2021/136644
PCT Pub. Date: Jul. 8, 2021

(65) Prior Publication Data

US 2022/0362848 A1 Nov. 17, 2022

(30) Foreign Application Priority Data

Dec. 30, 2019 (DE) ..... 10 2019 135 890.6

(51) Int. Cl.
*B22F 9/22* (2006.01)
*B22F 1/06* (2022.01)
*B22F 9/20* (2006.01)

(52) U.S. Cl.
CPC ..... *B22F 9/22* (2013.01); *B22F 1/06* (2022.01); *B22F 9/20* (2013.01); *B22F 2203/11* (2013.01); *B22F 2203/13* (2013.01); *B22F 2301/20* (2013.01)

(58) Field of Classification Search
None
See application file for complete search history.

(56) References Cited

U.S. PATENT DOCUMENTS

| | | | | |
|---|---|---|---|---|
| 4,915,733 | A | 4/1990 | Schütz et al. | |
| 7,531,126 | B2 | 5/2009 | Oh | |
| 7,988,760 | B2 | 8/2011 | Lunk et al. | |
| 2006/0051256 | A1 | 3/2006 | Oh | |
| 2008/0223175 | A1 | 9/2008 | Lunk et al. | |
| 2011/0175041 | A1* | 7/2011 | Muramatsu | B82Y 30/00 252/520.1 |
| 2012/0129090 | A1* | 5/2012 | Mamak | C01G 41/04 106/287.18 |
| 2014/0293554 | A1* | 10/2014 | Shashkov | C25D 11/024 428/209 |
| 2020/0010372 | A1* | 1/2020 | Yano | C22C 1/045 |
| 2020/0267913 | A1* | 8/2020 | Tsunematsu | A01G 13/0275 |

FOREIGN PATENT DOCUMENTS

| | | | |
|---|---|---|---|
| CN | 1766510 | A | 5/2006 |
| CN | 201748790 | U | 2/2011 |
| CN | 102603007 | B | 6/2014 |
| DE | 3802811 | A1 | 8/1989 |
| JP | 2005-324312 | A | 11/2005 |
| JP | 2007-211333 | A | 8/2007 |
| JP | 2012-197473 | A | 10/2012 |
| JP | 2019-173179 | A | 10/2019 |
| RU | 22530 | U1 | 4/2002 |
| WO | WO 2010/131653 | A1 | 11/2010 |
| WO | WO 2017/162048 | A1 | 9/2017 |
| WO | WO 2019/103037 | A1 | 5/2019 |
| WO | WO 2018/159644 | A1 | 9/2019 |

OTHER PUBLICATIONS

Abdullin Kh.A et al., Production of Nanosized Tungsten Oxide and Tungsten Oxide Powders, Physics of the Solid State, Jan. 2018, vol. 60, Issue 12, pp. 2634-2639.
Kolmakova L.P. et al., Reduction of Blue Tungsten Oxide with Hydrogen, Journal of Siberian Federal University, Technics and Technology, 4 (Jun. 2013), pp. 425-437.
Shveikin G.P. et al., Products of Carbothermal Reduction of Tungsten Oxides in Argon Flow, Russian Journal of Inorganic Chemistry, 2014, vol. 59, No. 3, pp. 291-296.
Biasin et al., "Investigation of CaO—CO2 reaction kinetics by in-situ XRD using synchrotron radiation", Chemical Engineering Science, vol. 127, Jan. 12, 2015, pp. 13-24.
Fouad et al., "Thermogravimetry of $WO_3$ reduction in hydrogen: Kinetic characterization of autocatalytic effects", Powder Technology, vol. 74, No. 1, Jan. 1, 1993, pp. 31-37.
International Search Report for PCT/EP2020/085987, dated Feb. 24, 2021, 3 pages.

* cited by examiner

*Primary Examiner* — Keith D. Hendricks
(74) *Attorney, Agent, or Firm* — Dority & Manning, P.A.

(57) ABSTRACT

The present invention relates to a process for producing tungsten metal powders by reducing tungsten oxide, which is characterized in that the properties of the metal powders obtained are continuously monitored in and during the ongoing process.

13 Claims, 1 Drawing Sheet

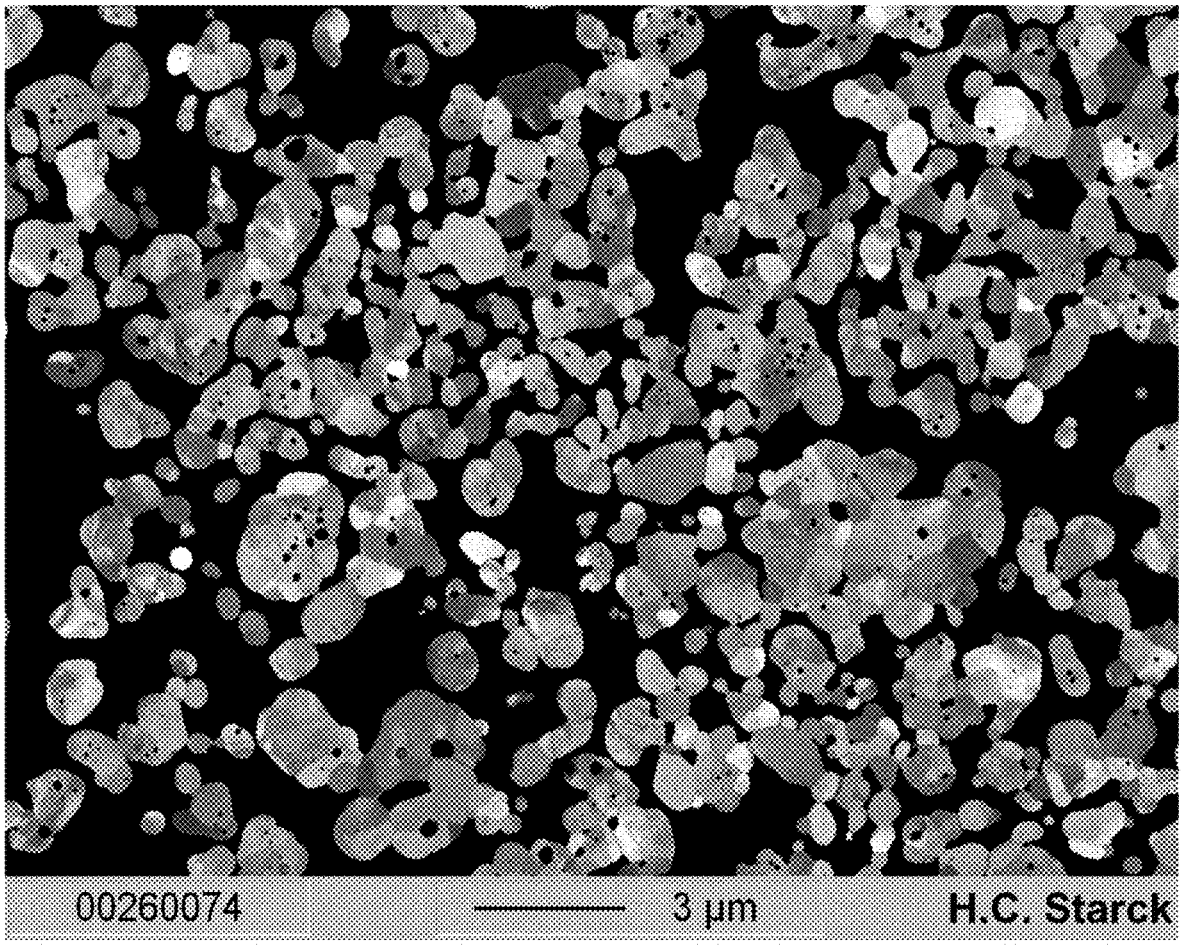
00260074
3 µm
H.C. Starck

PROCESS FOR PRODUCING TUNGSTEN METAL POWDERS

CROSS REFERENCE TO RELATED APPLICATIONS

This application is the national stage entry of International Patent Application No. PCT/EP2020/085987, having a filing date of Dec. 14, 2020, which claims priority to and the benefit of German Patent Application No. 10 2019 135 890.6, filed in the German Patent Office on Dec. 30, 2019, the entire contents of which are incorporated herein by reference.

The present invention relates to a process for producing tungsten metal powders by reducing tungsten oxide, which is characterized in that the properties of the metal powders obtained are continuously monitored in and during the ongoing process.

Tungsten metal is characterized by its high melting and boiling points, and is used in a large number of scientific, technical and medical areas, for example, as a precursor to tungsten carbide, which is used for preparing carbide tools. Depending on the application and field of use, there are different requirements and specifications concerning the tungsten metal, which is mostly employed in the form of powders. However, all specifications have in common that the powders must be provided reliably in a constantly high quality with a narrow or defined primary grain size distribution.

US 2006/0051256 describes a powder fabricating apparatus that is constructed in a way similar as a screw extruder, wherein the temperature can be controlled by means of various heating and cooling elements. The screw unit used in the apparatus is supposed to enable the growth of the produced particles to be controlled according to need.

DE 38 02 811 relates to a process for preparing a metal powder agglomerate of individual particles which consist of more than 70% by weight of one or more metals of the elements molybdenum, rhenium or tungsten and binder metals from the group comprising iron, cobalt, nickel, copper, silver, gold, palladium, platinum, rhodium, chromium and rhenium, in which the compounds of the metals and binder metals are dissolved and/or homogeneously suspended in ionic or non-ionic liquids, such solutions and/or suspensions are carried to dryness, and the thus obtained residue is roasted below 600° C., followed by reacting it under reducing conditions at temperatures of from 600 to 1200° C. to form a metal powder.

WO 2017/162048 discloses a method for the reduction of metal oxides, in which the reaction between a strong oxidizant or a metal halide and a reducing agent at temperatures of below 580° C. in a batch process is used for reduction of the metal oxide.

For the recovery of metallic tungsten, tungsten-containing ores can be calcined in an oxidizing atmosphere at temperatures of from 500 to 600° C. in order to remove any impurities. Reaction with aqueous sodium hydroxide solution yields $Na_2WO_4$, which is purified by serial reprecipitations, and crystallized to ammonium paratungstate through ion exchange or solvent extraction with ammonia. The tungstate obtained is filtered off, dried, and subsequently converted to pure tungsten(VI) oxide by calcining at temperatures of above 500° C. The actual metal powder is then obtained from the oxide in continuously working furnace plants using hydrogen as a reducing agent above a temperature of 650° C. The conversion of the oxide into the metal can be represented by the following equation:

$$WO_3+3H_2 \rightarrow W+3H_2O$$

Even though a number of methods for preparing tungsten metal has been known in the prior art, none of them offers the opportunity of a continuous quality control of the metallic powder formed. For checking the quality of the produced tungsten metal powder, samples are usually taken from the reaction flow, and analyzed, in which the conversion of the reaction and the grain size of the tungsten metal powder obtained are used as characteristics, in particular. Especially in those cases in which the metallic tungsten is to be processed further into tungsten carbide, the grain size of the tungsten metal powder is a critical quality characteristic. Since the grain size of the tungsten carbide highly depends on the grain size of the tungsten metal powder employed, the latter must be controlled and adjusted very precisely. Conventional processes employed in the prior art for controlling the quality of the tungsten metal powder have the disadvantage that there is always a time lag between the sampling and the analytical result's being available, so that an immediate adaptation of the process parameters in the production process is not possible. The time lag usually results from the necessity of a complicated sample processing and analysis, and transport distances where applicable. Thus, it may happen that in the needed time, which may be on the order of hours to days as a function of the existing infrastructure, the tungsten metal powder is not produced in the desired quality, and thus, side yields or stocks of non-utilizable powder grades are formed without one being able to perform a corresponding adaptation of the process parameters. Such undesirable products lead to a high capital lockup, and in the worst case, to a high loss of raw materials and resources. Therefore, in order to be able to overcome this problem of time-delayed quality control and the accompanying drawbacks, it is desirable to be able to perform the quality control in such a way that intervention is possible already in a timely manner during the ongoing production process.

In the production of tungsten metal powder, the oxygen content, the mean grain diameter and the specific surface area are usually employed to be able to evaluate the quality of the powders obtained. The mentioned material properties are determined by different methods each, so that a determination during the ongoing process is not possible, or must be done with different apparatus. Rather, in part, a complicated and time-intensive sample preparation is necessary in the analytical methods employed in the prior art, in order to be able to determine the mentioned material properties, so that an immediate response to any quality losses during the ongoing process is no longer possible.

Thus, it is the object of the present invention to provide a process for producing tungsten metal powders that allows for a timely and continuous quality assurance of the powders produced.

Surprisingly, it has been found that the content of intermediary tungsten(IV) oxide ($WO_2$) occurring during the preparation of metallic tungsten can be employed as a measure for the progress of the reaction and thus as a measure for the quality of tungsten metal powders. Further, it has surprisingly been found that the quality of the tungsten metal powder can be determined by the crystallite size of the tungsten metal powders obtained. Within the scope of the present invention, it has also been found that both parameters can be determined on-line during ongoing operation, so that a complicated sampling and sample processing is omitted, and timely measuring results are obtained that allow for immediate intervention in the process, if necessary.

Therefore, the present invention first relates to a process for producing tungsten metal powder by reducing tungsten oxide, which comprises the following steps:

a) providing a reaction stream I containing tungsten oxide particles;
b) treating the reaction stream I with a reducing agent to obtain a reaction stream II containing tungsten oxide and tungsten metal powder;
c) measuring the content of tungsten (IV) oxide ($WO_2$) in the reaction stream II;
d) measuring the crystallite size of the tungsten metal powder in the reaction stream II;
e) comparing the values obtained in steps c) and d) with predetermined target values;
f) optionally adjusting the process parameters;

characterized in that said measuring of the content of tungsten (IV) oxide ($WO_2$) and of the crystallite size of the tungsten metal powder during the process is effected by guiding the reaction stream past at least one analytical unit.

The present invention is characterized, inter alia, in that the crystallite size of the tungsten metal powder obtained is continuously determined during the process, and thus can be employed as a quality characteristic. The tungsten metal powder consists of primary particles, which may form aggregates. Each individual primary particle may be mono- or polycrystalline depending on its size. The domain of a particle in which a regular arrangement of the unit cells can be observed is referred to as a crystallite (also "grain" in the literature). These domains can extend throughout the volume of a particle. However, it is also possible that two or more domains in which the unit cells are arranged regularly exist in one particle, wherein the orientation of the major axes can differ between such domains. In such a case, grain boundaries can be observed between the domains. The smaller the crystallites, the more widely is an incoming X-ray scattered, which results in a broadening at the detector of an X-ray peak generated by diffraction.

By using the process according to the invention, a continuous and immediate monitoring of the reaction progress and of the crystallite size of the product is possible during the ongoing process, which could not be achieved with the previously practiced random sampling and the required time-consuming laboratory examinations. Further, the process according to the invention offers the possibility of a feedback, which is necessary for controlling the process in a closed loop. Thus, the powder can be efficiently produced in the desired quality without material losses.

The process according to the invention is particularly suitable for the quality assurance in the production of nanoscale and fine tungsten metal powders. Therefore, an embodiment of the process according to the invention is preferred in which the tungsten metal powder obtained has an average grain size of 20 nm to 5 μm, preferably 50 nm to 3.5 μm, as determined by means of a Fisher Sub Sieve Sizer FSSS I.m. according to ASTM B330. Further, an embodiment of the process according to the invention is preferred in which the tungsten metal powder obtained has a specific surface area of 0.05 $m^2/g$ to 10 $m^2/g$, preferably 0.15 $m^2/g$ to 6 $m^2/g$, as determined by the method for determining specific surface areas of powders according to BET (DIN ISO 9277).

The present invention is based on the fact that it has surprisingly been found that the already known correlation between the specific surface area (BET measurement according to DIN ISO 9277) and the average grain size of a powder can also be transferred to crystallites.

In contrast to the prejudices prevailing in the prior art, it has been found within the scope of the present invention that the known relationship between the grain or particle size of a powder and its BET surface area, which can be represented by the following equation:

$$d=6/(\rho*\mathrm{BET}) \qquad \text{[—Equation 1—]}$$

in which d is the particle size, p is the physical density of the material, and the BET value is the specific surface area as determined according to DIN ISO 9277.

The oxygen content of a completely reacted tungsten metal powder is proportional to the specific surface area of the powder and therefore can also be employed for the characterization of tungsten metal powders, and at the same time serves as a measure of the completeness of the conversion of the reaction. Both values, the crystallite size and the oxygen content, expressed as a proportion of $WO_2$, can be determined using X-ray diffraction. Therefore, in a preferred embodiment, the analytical unit used in the process according to the invention is an X-ray diffractometer, wherein the determination of the crystallite size of the tungsten metal powder and of the content of tungsten oxide is preferably effected by X-ray diffraction. Through the selection according to the invention of the crystallite size and the content of $WO_2$ in the reaction stream as parameters for quality assurance, the process according to the invention further has the advantage that both material properties can be determined by the same measuring method, i.e., the quality assurance can be effected combinedly in one step, so that a separate determination of the material properties in respectively separate measurements can be omitted.

According to the invention, the production of the tungsten metal powder is effected by reducing tungsten oxide, wherein it has been surprisingly found that the progress of the reaction can be followed by observing the content of tungsten oxide, especially $WO_2$. The lower the content of tungsten oxide in the reaction stream, the further has the reaction progressed. Therefore, an embodiment is preferred in which the content of tungsten oxide, especially $WO_2$, in the reaction stream II serves as a measure for the reaction progress.

The values determined in steps c) and d) of the process according to the invention are compared with predefined target values, in order to thus check the progress of the reaction and the quality of the tungsten metal powder obtained. The target values to be employed may be selected depending on the demands and individual specifications. In order to obtain a reliable comparison, the comparison in step e) of the process according to the invention is done repeatedly at short time intervals, preferably by using an evaluation module, especially by a computer-aided method.

The process according to the invention is compatible with the common reducing agents used in the production of tungsten metal powder. The best results relating to the conversion of tungsten oxide were observed in the use of hydrogen as a reducing agent. Therefore, an embodiment in which hydrogen is used as a reducing agent is preferred.

In addition to the possibility of a comprehensive quality control, the process according to the invention is further characterized by its simple implementation and the possibility of an immediate and continuous analysis of the reaction progress and the product control, which is achieved, inter alia, by the fact that the determination of the tungsten oxide content and of the crystallite size of the tungsten metal powder is executed by the same analytical unit. Therefore, an embodiment is preferred in which the measurements of the content of tungsten oxide, especially $WO_2$, and of the crystallite size of the tungsten metal powder in steps c) and d) of the process according to the invention are effected simultaneously, or immediately successively. Within the scope of the present invention, "immediately" means a time lag of not more than three minutes, preferably not more than one minute, especially not more than 30 seconds. More preferably, the two parameters are determined in one measurement, even more preferably with one recording, especially with an X-ray diffractogram or a section of an X-ray diffractogram. Such an embodiment has the advantage that only one measurement has to be performed, and only one sensor is needed in the analytical unit. The evaluation of the data obtained in the measurement can then be performed separately by known methods. In an alternatively preferred embodiment, the determination of the content of tungsten oxide, especially $WO_2$, and of the crystallite size of the tungsten metal powder in steps c) and d) of the process according to the invention is effected in respectively separate measurements, which are performed by the same analytical unit, however.

The process according to the invention enables an immediate feedback from the measuring result to the system parameters, whereby the process parameters can be constantly optimized during the process. Therefore, an embodiment of the process according to the invention is preferred in which the data determined in steps c) and d) serve as the basis for the adaptations of the process and system parameters that may have to be effected in step f) of the process according to the invention. Preferably, the adaptation of the system and process parameters is effected in such a way that the content of tungsten oxide and the crystallite size of the tungsten metal powder correspond to the predefined target values. The process and system parameters, which may be adapted on the basis of the values determined in steps c) and d), are preferably the pressure, temperature, temperature distribution, volume and mass flow, rotational speeds, concentrations, filling quantities, cycle times, and flow rate.

The process control according to the invention allows a large number of measurements to be performed per unit time, so that variations in the quality of the products can be responded to immediately. Preferably, the number of measuring values per hour, which are produced within the scope of the process according to the invention, is from 1 to 120, more preferably from 5 to 12. The measurements are preferably performed in and/or at the reaction stream of the continuously working production plant, whereby a course in time of the measuring signal and a time-accurate image of the reaction can be obtained. Thus, sampling from the product stream may preferably be omitted. In this connection, it has further proven advantageous if the amount of energy applied per measurement, expressed as the product of measuring time and measuring power, for example, the radiated power of a diffractometer, is chosen not too high, in order to avoid an influence on the ongoing reaction. Therefore, an embodiment is preferred in which the measurements are effected at a radiated energy of from 50 to 500 kJ, preferably from 80 to 250 kJ. The energy is calculated from the product of acceleration voltage U [Volt], the tube current I [Ampere], and the radiation time t [seconds] according to the following equation:

$$E=U[V]*I[A]*t[s].$$

The process according to the invention allows for an immediate control and comprehensive evaluation of the quality of the tungsten metal powder during the entire process. Thus, for example, it is possible to guide the reaction stream to be analyzed past different analytical units that are positioned at different sites along the process course, for example, in order to be able to monitor the reaction and the process in different stages.

Preferably, at least one analytical unit is where the product from the process is discharged from the process, for example, at the product outlet of a continuously working industrial furnace.

Therefore, one embodiment of the process according to the invention is preferred in which the reaction stream II is guided past more than one analytical unit. In a preferred embodiment, several analytical units are distributed along the reaction stream in order to enable a continuous monitoring during the entire process. Also preferred is an embodiment in which several analytical units are arranged immediately downstream of one another. Also preferred is a combination of these two embodiments. The different analytical units preferably have such a design that they are in mutual communication and are controlled centrally by a control unit, and the data obtained can be read out.

The present invention further relates to a device for performing the process according to the invention, wherein the device includes at least one analytical unit for measuring the content of tungsten oxide, especially $WO_2$, and of the crystallite size of tungsten metal powder in a reaction stream, wherein said analytical unit is preferably an X-ray diffractometer.

In particular, the present invention is suitable for quality assurance in the production of tungsten metal powder. Therefore, the present invention further relates to a process for quality assurance in the production of tungsten metal powder, in which the quality assurance of the tungsten metal powder is effected by monitoring the parameters of crystallite size of the tungsten metal powders and of tungsten(IV) oxide ($WO_2$) in the production stream, wherein the determination of these material properties is preferably effected by means of X-ray diffractometry.

FIG. 1 shows a scanning electron micrograph (SEM) of a tungsten metal powder embedded in resin and partially ground, which was produced by the process according to the invention; particles and mono- and polycrystalline domains can be seen.

The invention claimed is:

1. A process for producing tungsten metal powder by reducing tungsten oxide, which comprises the following steps:

a) providing a reaction stream I containing tungsten (VI) oxide particles;

b) treating the reaction stream I with a reducing agent to obtain a reaction stream II containing tungsten oxide and tungsten metal powder;

c) measuring the content of tungsten (IV) oxide ($WO_2$) in the reaction stream II;

d) measuring the crystallite size of the tungsten metal powder in the reaction stream II; and e) comparing the values obtained in steps c) and d) with target values for the content of tungsten (IV) oxide and the crystallite size of the tungsten metal powder;

characterized in that said measuring of the content of $WO_2$ and of the crystallite size of the tungsten metal powder during the process is effected by guiding the reaction stream past at least one analytical unit, wherein said measuring comprises a continuous and immediate monitoring of the conversion of $WO_2$ to tungsten metal powder performed in and/or at the reaction stream in a continuously working production plant and in the absence of sampling from the reaction stream.

2. The process according to claim 1, characterized in that the tungsten metal powder obtained has a specific surface area of 0.05 $m^2/g$ to 10 $m^2/g$ as determined by the method for determining specific surface areas of powders according to BET (DIN ISO 9277).

3. The process according to claim 1, characterized in that the at least one analytical unit used in the process according to the invention is an X-ray diffractometer.

4. The process according to claim 1, characterized in that the content of $WO_2$ in the reaction stream II serves as a measure for the reaction progress.

5. The process according to claim 1, characterized in that the determination of the content of tungsten oxide and of the crystallite size in steps c) and d) is effected simultaneously with an X-ray diffractogram or a section of an X-ray diffractogram.

6. The process according to claim 1, characterized in that adjusting of the process parameters is effected in such a way that the content of tungsten oxide and of the crystallite size correspond to the target values.

7. The process according to claim 1, characterized in that the number of measuring values per hour is from 1 to 120.

8. The process according to claim 1, characterized in that the measurements in steps c) and d) are effected at a radiated energy of from 50 to 500 kJ.

9. The process according to claim 2, characterized in that the tungsten metal powder obtained has a specific surface area of 0.15 $m^2/g$ to 6 $m^2/g$, as determined by the method for determining specific surface areas of powders according to BET (DIN ISO 9277).

10. The process according to claim 5, characterized in that the determination of the content of tungsten oxide and of the crystallite size in steps c) and d) is effected in one measurement.

11. The process according to claim 10, characterized in that the determination of the content of tungsten oxide and of the crystallite size in steps c) and d) is effected with one recording.

12. The process according to claim 7, characterized in that the number of measuring values per hour is from 5 to 12.

13. The process according to claim 8, characterized in that the measurements in steps c) and d) are effected at a radiated energy of from 80 to 250 kJ.

* * * * *